United States Patent [19]

Arnold

[11] Patent Number: 4,993,493

[45] Date of Patent: Feb. 19, 1991

[54] RETRIEVABLE LANDING METHOD AND ASSEMBLY FOR A WELL BORE

[75] Inventor: Ronald D. Arnold, Missouri City, Tex.

[73] Assignee: Texas Iron Works, Inc., Houston, Tex.

[21] Appl. No.: 44,423

[22] Filed: Apr. 30, 1987

Related U.S. Application Data

[63] Continuation of Ser. No. 911,861, Sep. 29, 1986, abandoned, which is a continuation of Ser. No. 729,733, May 2, 1985, abandoned.

[51] Int. Cl.[5] ..... E21B 23/00

[52] U.S. Cl. ..... 166/382; 166/117; 166/123

[58] Field of Search ..... 166/380, 382, 117, 123, 166/124, 125, 217, 250, 387

[56] References Cited

U.S. PATENT DOCUMENTS

| | | | |
|---|---|---|---|
| 3,910,349 | 10/1975 | Brown et al. | 166/290 |
| 3,920,075 | 11/1975 | Braddick et al. | 166/290 |
| 3,934,652 | 1/1976 | Cochran | 166/285 |
| 4,019,580 | 4/1977 | Garrett | 166/387 |
| 4,248,300 | 2/1981 | Braddick | 166/250 |
| 4,388,971 | 6/1983 | Peterson | 166/387 |
| 4,399,873 | 8/1983 | Lindsey, Jr. | 166/387 |
| 4,437,516 | 3/1984 | Cockrell | 166/124 |
| 4,440,233 | 4/1984 | Baugh et al. | 166/124 |
| 4,441,560 | 4/1984 | Baugh et al. | 166/382 |
| 4,477,104 | 10/1984 | Akkerman | 166/124 |
| 4,489,781 | 12/1984 | Weeks | 166/208 |
| 4,513,817 | 4/1985 | Weinberg | 166/382 |
| 4,522,259 | 6/1985 | Akkerman | 166/217 |
| 4,540,048 | 9/1985 | Gazda | 166/217 |
| 4,603,743 | 8/1986 | Lindsey, Jr. | 166/382 |
| 4,646,842 | 3/1987 | Arnold et al. | 166/382 |
| 4,690,220 | 9/1987 | Braddick et al. | 166/382 |

OTHER PUBLICATIONS

Otis Hydra-Set Liner Hanger System (Brochure, Copyrighted 1981, 1985).

1979-1980 Product/Service Catalog, Bakerline, a Division of Baker International Corporation.

Texas Iron Works, Inc. Catalog, 1986, 1987, p. 6145.

*Primary Examiner*—Bruce M. Kisliuk

*Attorney, Agent, or Firm*—Jack W. Hayden

[57] ABSTRACT

A retrievable landing method and assembly for lowering on a well string into a well bore a retrievable receptacle having a landing shoulder and sealably securing it in position on a tubular member landing seat. The retrievable receptacle is releasably coupled to the well string and after the retrievable receptacle landing shoulder engages the tubular member landing seat, the well string is manipulated to actuate the releasable coupling and release the well string for movement relative to the retrievable receptacle. Latch means associated with the retrievable receptacle are responsive to the well string manipulation to secure the retrievable receptacle sealingly with the well bore tubular member. Thereafter, if desired, hydraulic pressure may be applied between the retrievable receptacle and the well bore tubular member to test the seal, and tension and compression forces may be applied to the retrievable receptacle by manipulating the well string to assure that it is properly positioned and secured to the well bore tubular member.

45 Claims, 4 Drawing Sheets

RETRIEVABLE LANDING METHOD AND ASSEMBLY FOR A WELL BORE

This is a continuation of co-pending application serial no. 911,861 filed on Sep. 29, 1986, now abandoned which is a continuation of application Ser. No. 729,733 filed May 2, 1985 now abandoned.

CROSS REFERENCE TO RELATED APPLICATIONS

The subject matter of this application relates generally to the subject matter of Application Serial No. 602,538 filed Apr. 20, 1984 for "Retrievable Well Bore Assembly", now U.S. Pat. No. 4,646,842 and Application Serial No. 729,231 filed may 1, 1985 for "Tubular Member Anchoring Arrangement and Method", now U.S. Pat. No. 4,690,220 both of which applications are assigned to the assignee of this application.

FIELD OF THE INVENTION

This invention relates to oil and gas well production tools and methods for use in a well bore and more particularly to a retrievable landing method and assembly for landing and retrievably securing a retrievable receptacle in a well bore tubular member by manipulating the well string on which the retrievable receptacle is lowered into the well bore.

DESCRIPTION OF THE PRIOR ART

U.S. Pat. Nos. 4,399,873 and 4,248,300 issued on Aug. 23, 1983 and Feb. 3, 1981, respectively are representative of the prior art. The references to the composite catalogue in U.S. Pat. No. 4,399,873 are also representative of the prior art.

U.S. Pat. No. 4,399,873 requires the injection of liquid into the well along with a closure device to actuate the mechanism. Well operators are not always desirous of introducing foreign objects or liquids into a well bore if such can be avoided. Also, a hydraulic device which requires dropping a closure in the well may not function satisfactorily, if at all, in horizontal well drilling.

DESCRIPTION OF THE PRESENT INVENTION

Many oil and gas well pipe strings have what is referred to as a polished receptacle therein which is normally provided with a landing seat and a latching groove for enabling a retrievable receptacle having a landing shoulder to be seated on the landing seat and removably secured in the polished receptacle by latch means engaging in the groove.

Accordingly, it is an object of the present invention to provide a retrievable landing method and assembly for lowering, positioning and latching a retrievable device in a tubular member, such as by way of example only, a packer bore receptacle. The foregoing is accomplished by manipulation of the well string on which the retrievable receptacle is releasably coupled for lowering into the well bore and further the invention contemplates conducting suitable tests as desired such as pressure tests to test any seals provided between the retrievable receptacle and the tubular member, as well as the application of compressive and tension forces to the tubular receptacle by manipulating the well string.

The well string is releasable from the receptacle for retrieval, and the invention further provides an arrangement so that the retrievable receptacle can be unlatched from the well bore tubular member and retrieved therefrom when desired.

DESCRIPTION OF THE PREFERRED EMBODIMENTS

Figure 1A:
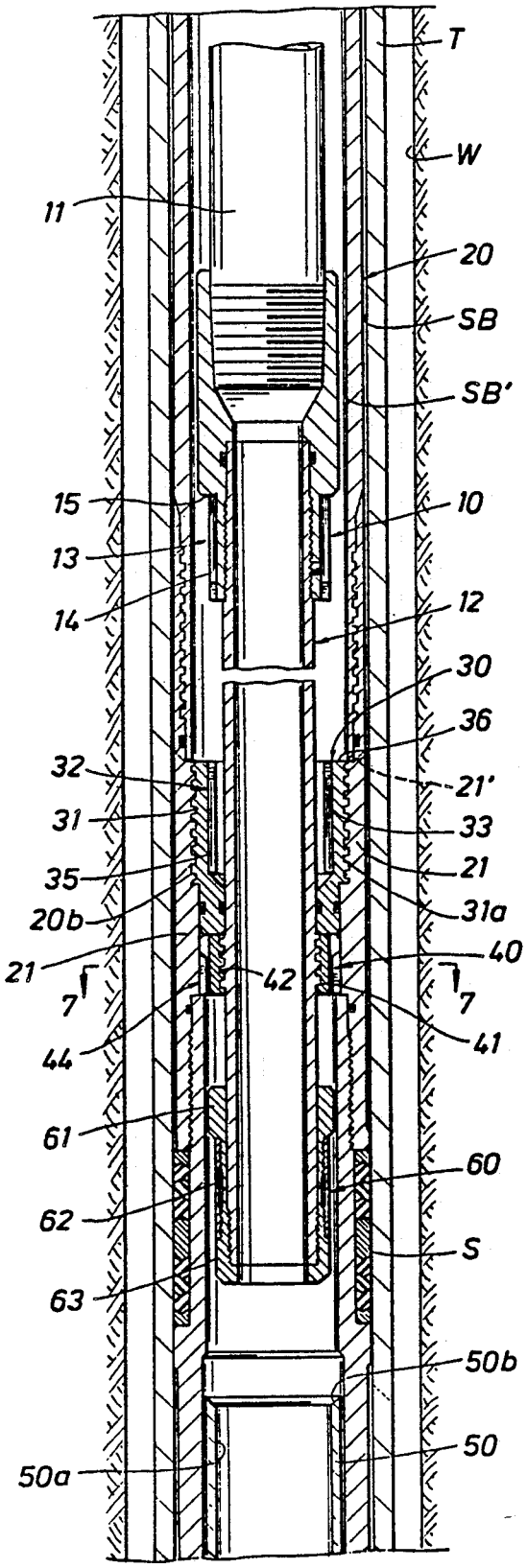
FIGS. 1A, 1B are longitudinal vertical section views of the upper and lower portion, respectively, of the preferred embodiment of the retrievable landing assembly and demonstrating the relationship of the components with a retrievable receptacle releasably coupled with the landing assembly and lowered into a well bore tubular member with a landing shoulder and latching groove.
Figure 2A:
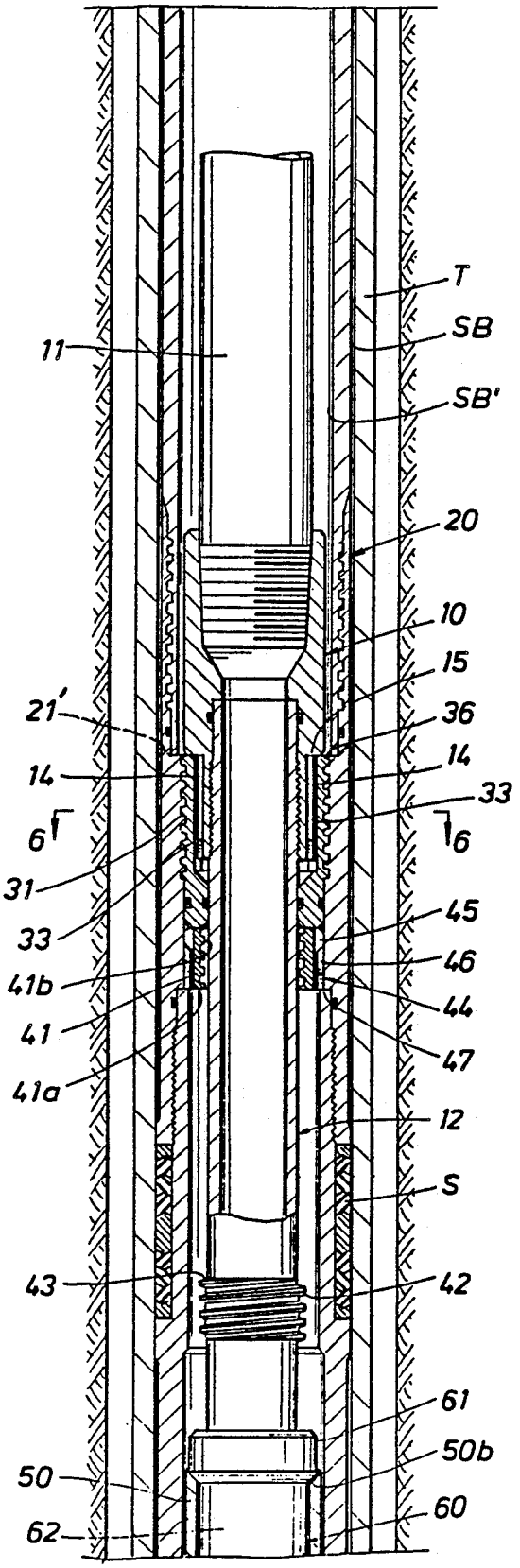
FIGS. 2A and 2B are longitudinal vertical sectional views similar to FIGS. 1A and 1B and demonstrate the relative position of the components of the landing assembly and the retrievable receptacle after the retrievable receptacle has landed on the landing seat whereby the well string may be manipulated to actuate the latching means for latching with the well bore tubular member latching groove. These views also demonstrate the relative position of the components for applying a compressive force to the retrievable receptacle to assure it is properly positioned and latched with the well bore tubular member.

Attention is first directed to FIGS. 1A and 2A of the drawings where the retrievable landing assembly is referred to generally by the numeral 10. A well bore W is provided with a tubular member T having a seal bore SB therein in which a retrievable receptacle is to be received. The retrievable receptacle at 20 includes a retrievable landing nipple 21 which in the embodiment illustrated includes a longitudinally extending packer bore receptacle or seal bore SB' threadedly engaged with the retrievable landing nipple 21. If it is desired to employ only the retrievable landing nipple 21, then the receptacle portion above the dotted line 21' is eliminated. That is, the receptacle will end at the dotted line 21'.

The retrievable landing assembly 10 is adapted to be secured with a well spring 11 whereby the retrievable receptacle 20 and retrievable landing assembly 10 may be lowered into the well bore tubular member T. The retrievable receptacle 20 is releasably coupled by coupling means 30 with the well string 11, and more particularly is coupled to the lower portion of the well string which is designated tool means wherein and refereed to generally by the numberal 12. The coupling means 30 includes release means 40 and this arrangement initially couples the retrievable receptacle 20 to the tool means 12 as illustrated in FIG. 1A. When desired, the release means 40 may be actuated by manipulation of the well string 11 to release the well string and tool means 12 from the retrievable receptacle 20 for relative telescopic movement therebetween to secure the retrievable receptacle to the tubular member T. The arrangement, however, precludes premature withdrawal of the tool means 12 from the retrievable receptacle during manipulation of the tool means 12 while positioning and securing the retrievable receptacle 20 to the tubular member T as will be described.

Figure 1B:
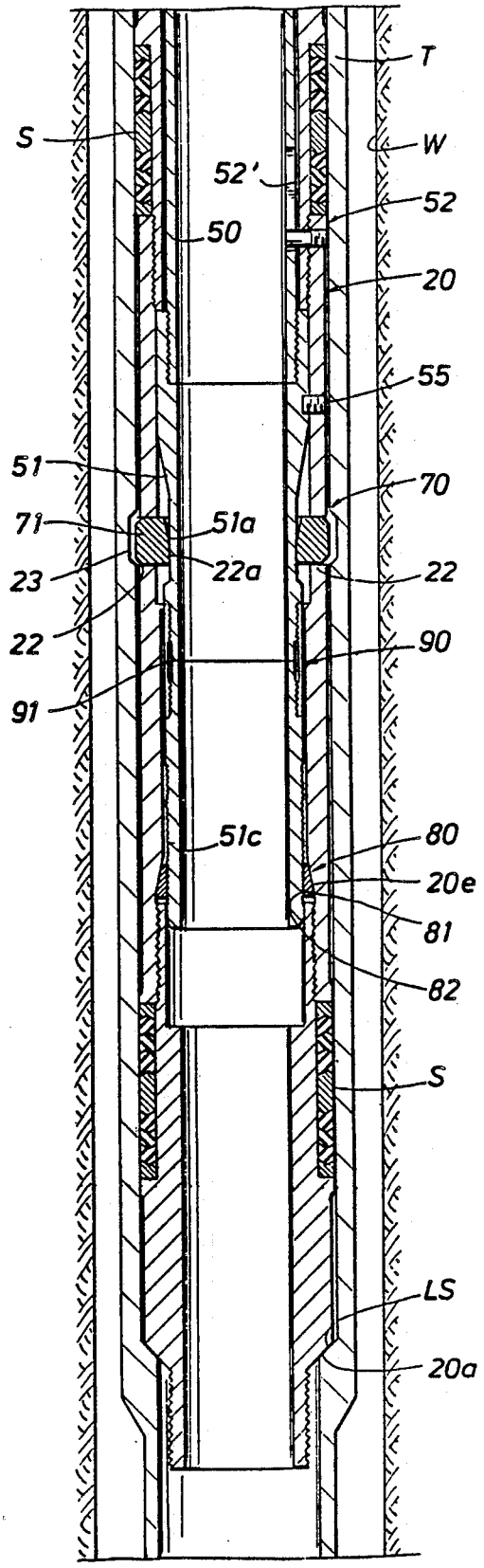

The tubular member T is positioned in the well bore W in a manner well known in the art and is provided with an internal annular landing LS for receiving the external annular landing shoulder 20*a* of the retrievable receptacle 20 as shown in FIG. 1B. A setting sleeve 50 is telescopically coupled by means referred to generally at 52 to the retrievable receptacle for accommodating relative longitudinal movement therebetween. Means 55 comprising suitable frangible means such as a shear pin initially inhibit telescopic movement between the setting sleeve 50 and retrievable receptacle 20 as the retrievable receptacle and landing assembly are lowered into position in the tubular member T.

Suitable test means referred to generally at 60 are provided to enable to compressive force to be applied to the setting sleeve 50 and the retrievable receptacle 20 to determine if it has been properly latched with the retrievable receptacle. A suitable latch arrangement referred to generally at 70 is responsive to manipulation of the well string 11 and tool means 12 for actuating to retrievably latch the retrievable receptacle 20 to the tubular member T.

Retainer means referred to generally at 80 are provided for retaining the latch arrangement 70 actuated to maintain the retrievable receptacle 20 secured in the tubular member T, until it may be desired to remove the retrievable receptacle 20 from the tubular member T. Disabling means referred to generally at 90 are positioned between the latch means or arrangement 70 and the retainer means 80 which are responsive to a fishing tool such as a grappling tool 100 shown in FIG. 5 to disable the functioning of the retainer means so that the latch means 70 may be actuated to unlatch from the tubular member T and removed therefrom.

After the release mans 40 of coupling means 30 has been actuated to release the tool means 12 for manipulation to actuate the setting sleeve 50 for operation of the latch arrangement 70, various tests may be conducted as desired to assure that the retrievable receptacle 20 is seated and latched properly in the tubular member T. If desired, hydraulic pressure may be injected to the well through the well string and between the retrievable receptacle 20 and tubular member T to test the seals S on the retrievable receptacle which sealingly engage with the tubular member T. If desired, the well string 11 also may be manipulated to apply a tension fore and/or a compressive force to the retrievable receptacle to assure that it properly positioned and latched in the tubular member.

When it is desired to remove the well string 11 with the tool means 12 thereon from the retrievable receptacle 20, additional means referred to generally at 13 on the tool means 12 and cooperable additional means 32 on the coupling member 31 of the coupling means 30 may be engaged by manipulating the well string 11 to rotate the coupling member 31 to disengage if from the retrievable receptacle 20 whereupon the well string 11, tool means 12, coupling means 30 including the release means 40 and test means 60 of tool means 12 may be withdrawn from the retrievable receptacle 20 and retrieved to the earth's surface.

Should it be desirable at a later date to remove the retrievable receptacle 20 from the well bore, any suitable grapple tool well known in the art such as a spear or the like as represented generally at 100 in FIG. 5 may be lowered through the tubular member T and engaged in the upper end 50*a* of the setting sleeve 50 as shown whereupon a pull on the well string 11 will actuate the disabling means 90 and render the retainer means 80 ineffectual so that the retrievable receptacle 20 may be unlatched from the tubular member 20 for removable therefrom.

The additional means 13 comprise longitudinally extending, circumferentially spaced projections 14 adjacent the upper end of the tool means 12 as shown in FIG. 1A of the drawings.

Figure 6:
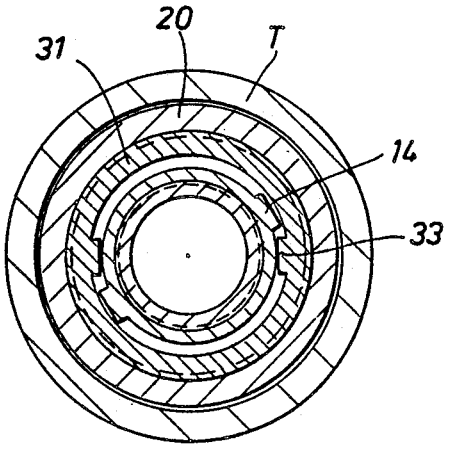
FIG. 6 is a sectional view on the line 6—6 of FIG. 2A illustrating in greater detail the additional means on the tool means and coupling means.
Figure 7:
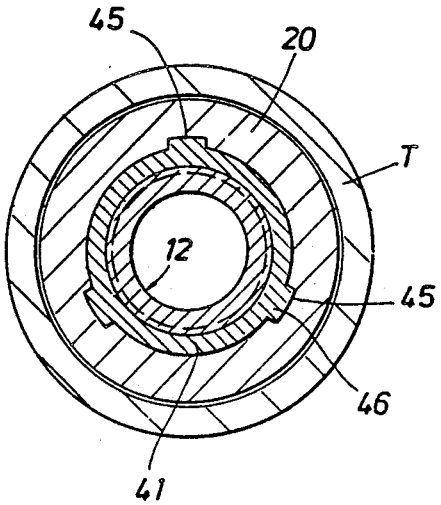
FIG. 7 is a sectional view on the line 7—7 of FIG. 1A illustrating the splined connection of the annular member of the releasable means with the retrievable receptacle.

Cooperable additional means 32 in the form of longitudinally extending projecting members 33 are provided in the longitudinal bore 35 formed in the coupling member 31 which are adapted to be engaged by the members 14 when the well string 11 is manipulated, and in this instance, lowered so as to position members 14 adjacent members 33 as better illustrated in FIG. 6 of the drawings. Positioning of members 14 adjacent members 33 as shown in FIG. 6 enables rotation to be imparted to the coupling member 31 which is provided with suitable threads 31*a* on its exterior surface for engaging with threads 20*b* on the interior of the retrievable receptacle 20 so that the member 31 may be threadedly disengaged therefrom by rotation of well string 11 and tool 12 to uncouple the well string 11 and tool means 12 from the retrievable receptacle 20. The coupling member 31 abuts member 41 of release means 40 when the coupling member is secured to retrievable receptacle 20 as shown in FIG. 1 and this prevents longitudinal displacement of release means 40 from the retrievable receptacle 20 until coupling member 31 has been disengaged from the retrievable receptacle 20.

Figure 3:
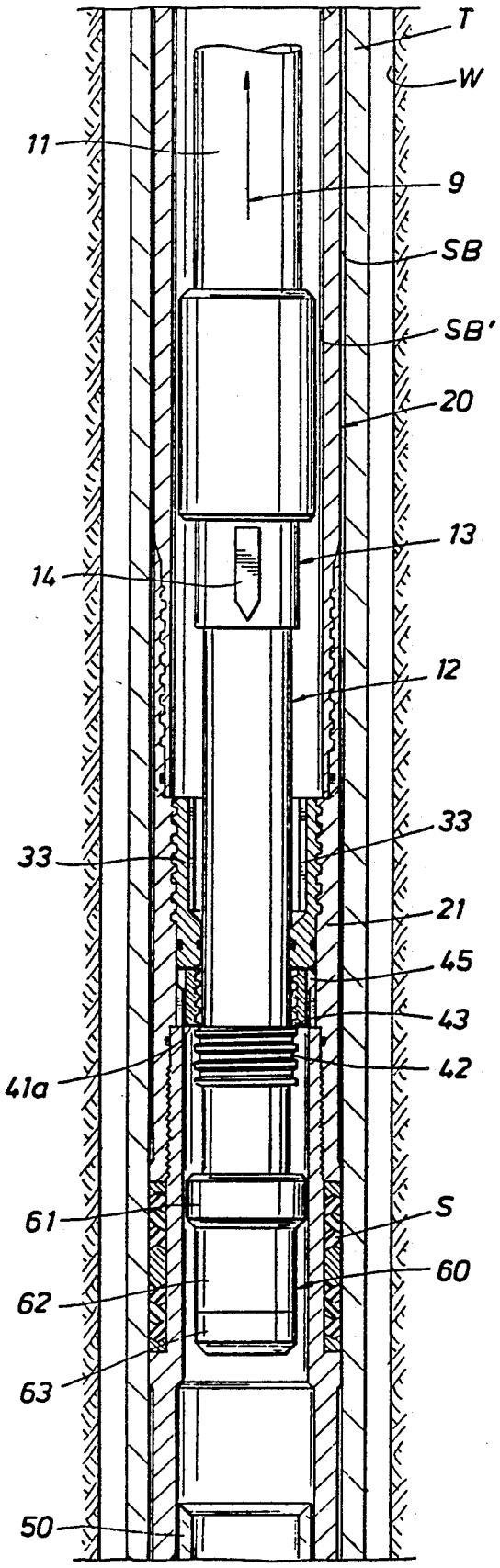
FIG. 3 is a longitudinal vertical sectional view of the landing assembly demonstrating the relative position of the components when a tension force is applied to the retrievable receptacle to assure that the retrievable receptacle is properly latched to the well bore tubular member.
Figure 4:
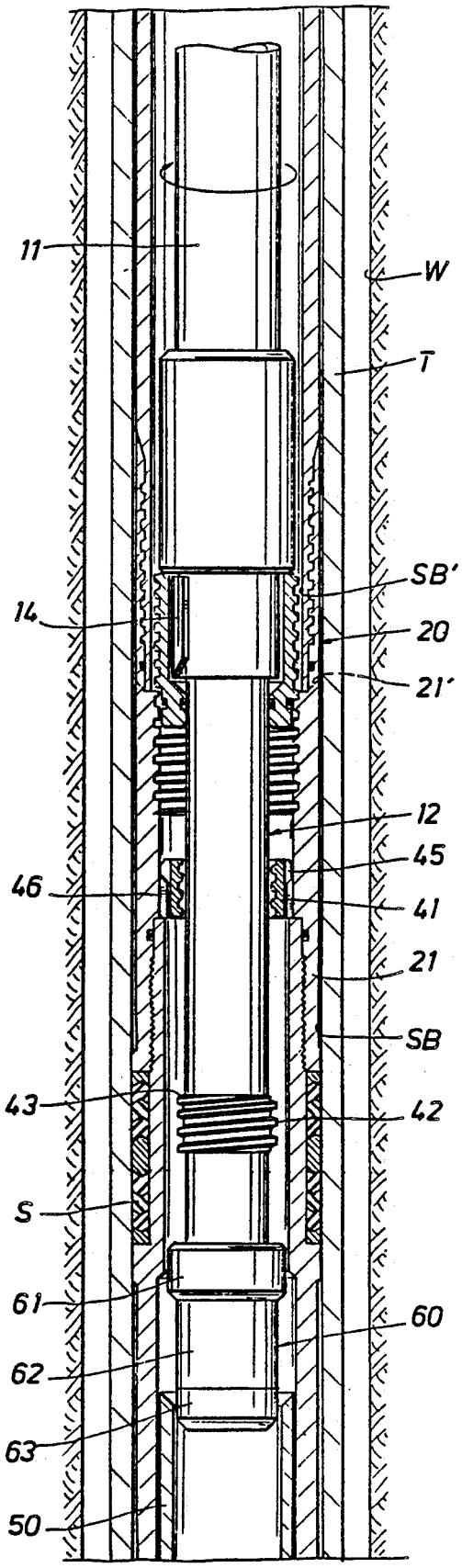
FIG. 4 is a longitudinal vertical sectional view similar to FIG. 3 and demonstrates the relative position of the landing assembly components when the coupling means is actuated to release from the retrievable receptacle for removal of the landing assembly therefrom.

As long as the coupling means 30 remains in the position demonstrated in FIGS. 1A, 2A and 3 of the drawings, the end surface 36 of the coupling member 31 limits downward movement of the well string and tool means 12 relative thereto.

Similarily, after the release means 40 has been actuated so that the annular member 41 is disengaged from the threaded portion or surface 42 on the tool means 12 as shown in FIG. 2A, the uppermost or end thread 43 of such threaded portion 42 and the lowermost end 41*a* of the splined annular member 41 limit upward movement of the well string 11 and tool means 12 relative to the retrievable receptacle 20. The surfaces 15, 36, 41*a*, 43, the end surface of 46 and surface 47 accommodate manipulation of the well string 11 and tool means 12 to position and latch the retrievable receptacle 20 relative to the tubular member T, while inhibiting premature or undesired removal of the tool 12 of well string 11 from the retrievable receptacle 20 while it is being positioned and latched relative to the tubular member T.

After the retrievable receptacle 20 has been landed on the landing shoulder LS, it may be desired to conduct a pressure test to determine the sealing engagement of seals S with the tubular member T. As previously noted, the retrievable receptacle may be provided with an upwardly extending seal bore SB which extends upwardly above the dotted line indication 21'. At any event, the seal bore portion of tubular member T adjacent the lower most seals S on the retrievable landing nipple portion 21 of retrievable receptacle 20 adjacent the landing shoulder 20*a* may be tested hydraulically for sealing engagement with the tubular member T as well as the seals engaging the sealing bore portion SB above the dotted line designation 21'. As previously noted, this is conducted by injecting hydraulic fluid through the well string and out the lower end of the tubular member T. Since the tubular member T is cemented in the well bore, it is closed off at its lower end from the well bore formation and such hydraulic fluid passes upwardly between the retrievable receptacle 20 and tubular member T for testing the sealing engagement of seals S in the seal bore SB of the tubular member T.

Thereafter, the release means 40 may be acutated to disengage the tool means 12 from the retrievable receptacle for manipulation of the well string 11 and tool means 12. This, in the embodiment demonstrated, is accomplished by the rotation of the well spring 11 to threadedly disengage the threaded portion 42 of the tool means 12 from the threads 41*b* on the interior of annular member 41. The member 41 is splined to the retrievable receptacle as illustrated generally at 44 in FIG. 2A by means of longitudinally extending circumferentially spaced grooves 45 in the retrievable receptacle 20 which receive the longitudinal and externally projecting keys 46 on annular member 41. The lower end surface of keys 46 rest on the shoulder surface 47 of the retrievable receptacle 20 as shown and thus retains its position relative to coupling member 31 after the threaded portion 42 has been disengaged from the splined member 41.

After disengagement, the well string 11 is manipulated, and in the embodiment illustrated, it is lowered as shown in FIG. 2A so that the shoulder on annular member 61 on the upper end of test means 60 abuts the upper end 50*b* of the setting sleeve 50. Sufficient compressive force is applied by lowering well string 11 to break the frangible means 55 retaining setting sleeve 50 in its initial position as demonstrated in FIG. 1B of the drawings which prevents premature actuation of the latch arrangement 70 as the landing assembly is lowered into the well bore. Thereupon sleeve means 50 is free to move longitudinally relative to retrievable receptacle 20.

Setting sleeve 50 is provided with an annular longitudinally extending conical surface 51 and an adjacent cylindrical surface 51*a* of reduced diameter as shown. The reduced diameter portion 51*a* is adjacent latch members 71 supported in apertures 22 of the retrievable receptacle 20 when the latch members are retracted as illustrated in FIG. 1B of the drawings with their inner end surfaces 22*a* adjacent the reduced annular surface 51*a* as the retrievable receptacle is initially positioned in the tubular member T. When the setting sleeve 50 is moved downwardly by a compressive force on the tool means 12 to engage the sleeve 50 as shown in FIG. 2A, the conical surface 51 urges the latch members 71 to extended position into the latching groove 23 in the tubular member T as shown in FIG. 2B of the drawings.

Figure 2B:
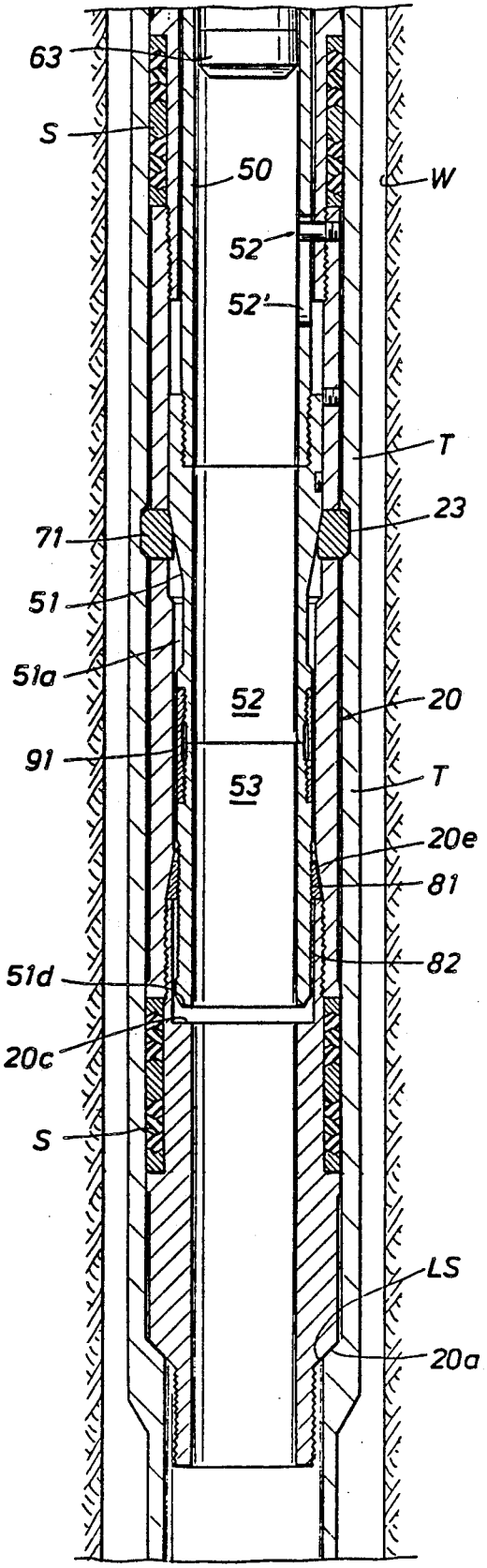

AS the setting sleeve 50 shifts or moves downwardly, a threaded ratchet ring 81 ratchets along ratchet threads 82 formed along the lower end 51*c* of sleeve portion 53 of the sleeve means 50 as shown in FIGS. 1B and 2B of the drawings. The threads on ratchet ring 81 face in an opposite direction relative to the threads 82 and when the latch means 70 has latched the retrievable receptacle 20 to tubular member T and the compressive force released from the setting sleeve 50, the ratchet ring 81 will retain the position it has attained on the ratchet threads 82 and thereby retain the sleeve means 50 in telescoped relation relative to the retrievable receptacle 20 as shown in FIG. 2B of the drawings. The ratchet ring 81, threads 82 and conical surface 20*e* on retrievable receptacle 20 form a ratcheting arrangement between the retrievable receptacle 20 and the sleeve 50 to lock the sleeve 50 to the retrievable receptacle 20 when the latch means 70 secures the retrievable receptacle to the tubular member T.

Thereafter, the well string 11 and tool 12 may be manipulated as represented by the arrow 9 in FIG. 3 so that the uppermost thread 43 on the threaded portion 42 of the tool means 12 abuts the lower end 41*a* of splined member 41. The thread 43 and end 41*a* form cooperable means whereby tension force may thus be applied to the retrievable receptacle 20 to assure that it is properly latched and positioned in the tubular member T and will not prematurely remove therefrom.

If desired, a compressive force may be applied to the retrievable receptacle 20 to further test for assurance that it is properly postioned and seated and this test may be conducted after the latch arrangement 70 is initially actuated, or at some later sequence in the operation. In this test the annular member 61 is seated on the upper end of 50*b* of the setting sleeve 50 as shown in FIG. 2A and a compressive force applied through the well string.

It will be noted that the test means 60 not only includes the annular member 61, but a frangible collar 62 which is secured with 61 and extends between it and the lower end member 63. The frangible collar or sleeve 62 couples or supports annular member 61 on member 63 and member 63 is threadedly connected on well tool 12. If proper positioning of the retrievable receptacle 20 and latching thereof has not been effected, the spacing of the tool components is such that shoulder 15 on well string 11 can not seat on shoulder 36 of coupling means 30. For example, if sediment or foreign substance prevents the lower end 51*d* of the setting sleeve 50 from moving down a predetermined distance to enable latch members 71 to properly engage in groove 23, then shoulder 15 can not seat on shoulder 36. In such event the shoulder on member 61 will engage the upper end 50*b* of sleeve 50 as shown in FIG. 2A and the compressive load applied through the well string will be transmitted directly to the annular member 61 and such load in relation to the shear strength of frangible member 62 is such that member 62 will shear thus accommodating movement of the well string 11 indicating that the latch arrangement 70 is not properly actuated so that the latch members 71 are properly engaged in the latching groove 23. Also, the foregoing functions as a safety feature and provides a means to enable projections 14 and 33 to engage and release coupling member 31 so that well string 11 may be removed from the well bore.

It will be noted that the setting sleeve 50 includes two separate sleeve portions 52, 53. The portion 52 terminates between the latch arrangement 70 and the disabling means 90 and is joined to the sleeve portion 53 by a frangible collar or sleeve 91 which joins and holds or connects the portions 52 and 53 together.

Figure 5:
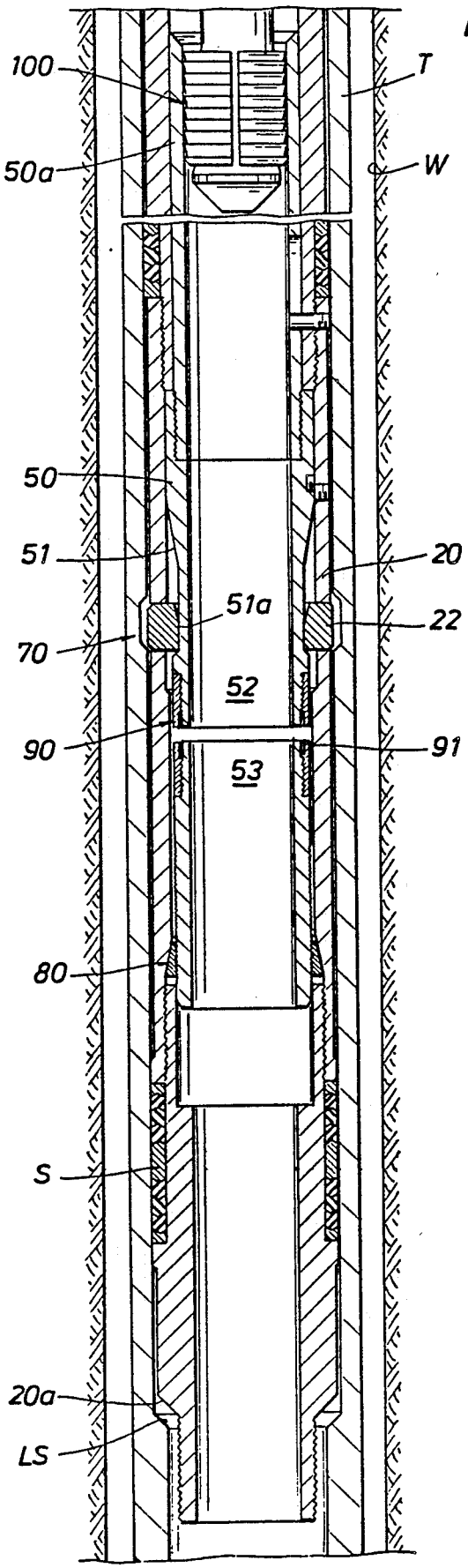
FIG. 5 is a partial longitudinal sectional view showing fishing tool means, such as a spear, engaged with the upper end of the setting sleeve for actuating the disabling means as demonstrated in the drawing to retrieve the retrievable receptacle from the tubular member.

As illustrated in FIG. 5 when a grappling tool, such as a spear represented at 100 is lowered on a well spring and engaged within the upper end portion 50*a* of the sleeve 50 to exert an upward pull or tension force thereon, this breaks the frangible sleeve 91 and separates 52, 53 so that 52 may move upwardly to align the latch members 71 with the reduced diameter portion 51*a* on the setting sleeve 50 so that they may retract into the apertures 22 in the retrievable receptacle 20 as the receptacle 20 is withdrawn from the tubular member T by spear 100 and supporting well string.

The retainer means 80 retains its position shown in FIGS. 2B and 5 by reason of the fact that the retainer ring 81 is conically shaped and abuts the conically shaped surface 20*e* on retrievable receptacle 20 as shown in FIG. 2B of the drawings so that it remains lockingly engaged with the threads 82 on sleeve portion 53. Thus, the entire sleeve means 50 along with the retrievable receptacle 20 will be withdrawn from the well bore member T by the foregoing arrangement.

SImilarily, when the coupling means 30 is disabled or disconnected from the retrievable receptacle 20 by engagement of the additional means 13 and 32 as previously described so as to unthread the coupling member 31 from the retrievable receptacle 20, the thread 43, upon elevating the well string, abuts the lower end of member 41 and moves it longitudinally out of the grooves 45 in the retrievable receptacle 20 to lift coupling member 31 along with the well string 11 and tool 12 as they are moved upwardly out of receptacle 20.

The foregoing disclosure and description of the invention are illustrative and explanatory, thereof, and various changes in the size, shape and materials as well as in the details of the illustrated construction may be made without departing from the spirit of the invention.

What is claimed is:

1. A retrievable landing assembly for positioning a retrievable receptacle having a landing shoulder in a well bore tubular member provided with a landing seat and a latching groove for receiving therein latch members supported on the retrievable receptacle to secure the retrievable receptacle to the tubular member including:

setting sleeve means;

tool means movable to actuate said setting sleeve to urge the latch members into the latching groove;

securing means to secure said setting sleeve and the retrievable receptacle together against relative longitudinal movement, said securing means releasable by moving said tool means longitudinally to release said setting sleeve from the retrievable receptacle and urge the latch members into the tubular member latching groove;

coupling means connecting said tool means to the retrievable receptacle against relative longitudinal movement;

said coupling means including releasable connecting means which accommodates relative rotation and longitudinal movement between said tool means and the retrievable receptacle when the retrievable receptacle landing shoulder is engaged on the tubular member landing seat to actuate said setting sleeve for urging the latch members into the latching groove; and said coupling means including additional means securing said tool means to the retrievable receptacle which additional means is operative after said tool means is released from the retrievable receptacle to accommodate longitudinal movement of said tool means while preventing removal of said tool means from the retrievable receptacle, said additional means operable by rotation of said tool means to disconnect said tool means from the retrievable receptacle for removable from the retrievable receptacle.

2. The retrievable landing assembly of claim 1 including retainer means to retain said setting sleeve and the retrievable receptacle in latched relationship with the tubular member.

3. The retrievable landing assembly of claim 1 including cooperable means on the retrievable receptacle and said tool means engageable upon relative movement between said tool means and the latched retrievable receptacle and setting sleeve whereby tension may be applied to the retrievable landing assembly to assure that the retrievable receptacle is latched to the tubular member, said cooperable means including surface means on said tool means and the retrievable receptacle which abut upon relative movement between said tool means and retrievable receptacle.

4. The retrievable landing assembly of claim 1 including seal means on the retrievable receptacle for sealably engaging with the tubular member.

5. The retrievable landing assembly of claim 1 including disabling means to release said latch means when a tension is applied to said setting sleeve for retrieval of the setting sleeve and retrievable receptacle from the tubular member.

6. The retrievable landing assembly of claim 5 including retainer means to retain said setting sleeve in latched relationship with respect to the tubular member and wherein said disabling means includes a frangible member connecting separable portions of said setting sleeve between said latch means and said retainer means, said frangible member being separable upon the application of a predetermined force to said setting sleeve above said frangible member to permit movement of said setting sleeve relative to said retrievable receptacle for retraction of said latch means from the tubular member latching groove.

7. THe retrievable landing assembly of claim 1 including test means responsive to compressive loading of the retrievable receptacle by said tool means to assure that said retrievable receptacle is latched to the tubular member.

8. The retrievable landing assembly of claim 7 wherein said test means includes a frangible member carried by said tool means breakable in response to predetermined loading of said setting sleeve when engaged by said tool means if said setting sleeve has not shifted to properly latch said latch means in the tubular member latching groove.

9. A retrievable landing assembly for positioning a retrievable receptacle having a landing shoulder in a well bore tubular member provided with a landing seat and a latching groove for receiving therein latch members supported on the retrievable receptacle to secure the retrievable receptacle to the tubular member including:

setting sleeve means within the retrievable receptacle;

tool means movable to engage and actuate said setting sleeve to urge the latch members into the latching groove;

securing means releasably securing said setting sleeve means to the retrievable receptacle, said securing means releasable by engagement of said tool means with said setting sleeve means to release said securing means whereby said setting sleeve means may be moved downwardly by said tool means to engage the latch members and secure the retrievable receptacle in the tubular member;

connecting means securing said tool means with the retrievable receptacle to prevent said tool means from moving said setting sleeve means downwardly relative to the retrievable receptacle, said connecting means actuatable upon manipulation of said tool means to release said tool means from the retrievable receptacle for longitudinal movement of said tool means to engage and move said setting sleeve means downwardly to move the latch members into the latching groove; and additional means securing said tool means to the retrievable receptacle, said additional means, after said connecting means has been actuated, accommodating longitudinal movement of said tool means relative to the retrievable receptacle while preventing withdrawal of said tool means from the retrievable receptacle, said additional means operable by manipulation of said tool means to release said tool means from the retrievable receptacle.

10. The retrievable landing assembly of claim 9 wherein said connecting means includes a member, said member, tool means and the retrievable receptacle having cooperating engagable surface means to restrain relative movement therebetween, said tool means upon manipulation thereof when the retrievable receptacle landing shoulder is engaged on the tubular member landing seat being releasable from said member and the retrievable receptacle for movement longitudinally of the retrievable receptacle to move said setting sleeve.

11. The retrievable receptacle of claim 9 wherein said connecting means includes a member, said connecting means member and the retrievable receptacle having coengagable surfaces to restrain relative rotation therebetween, said tool means and said connecting means member having engaged threaded surfaces which disengage upon rotation of said tool means relative to said connecting means member and retrievable receptacle when the retrievable receptacle landing shoulder is engaged on the tubular member landing seat which disengagement accommodates longitudinal movement of said tool means for engaging said tool means with said setting sleeve means, and wherein said additional means includes threaded means threadedly engaging the retrievable receptacle, said threaded means accommodating relative longitudinal movement of said tool means with respect to the receptacle, and said threaded means releasable from the retrievable receptacle by rotation of said tool means for removal with said tool means from the retrievable receptacle.

12. The retrievable landing assembly of claim 11 wherein said additional means includes projecting surfaces on said additional means and said tool means coengageable upon manipulation of said tool means whereby rotation may be imparted to said additional means to release it from said retrievable receptacle.

13. A method of securing a retrievable receptacle having a landing shoulder in a well bore tubular member provided with a landing seat and a latching groove for receiving therein latch members supported on the retrievable receptacle to secure the retrievable receptacle to the tubular member comprising the steps of:

releasably connecting the retrievable receptacle with tool means for lowering and positioning the retrievable receptacle landing shoulder on the well bore tubular member landing seat;

maintaining the tool means connected with the retrievable receptacle to prevent relative longitudinal movement therebetween while lowering and positioning the retrievable receptacle on the well bore tubular member landing seat;

manipulating the tool means for longitudinal receptacle to urge the latch members into the latching groove to secure the retrievable receptacle to the tubular member;

maintaining the tool means connected with the retrievable receptacle while moving the tool means longitudinally to secure the retrievable receptacle to the tubular member; and manipulating the tool means to disconnect and remove the tool means from the retrievable receptacle.

14. The method of claim 13 including the additional step of lowering a grapple on a well string into the retrievable receptacle to engage and apply tension to the setting sleeve for unlatching and retrieving the retrievable receptacle from the well bore tubular member.

15. A method of securing a retrievable receptacle having a landing shoulder in a well bore tubular member provided with a landing seat and a latching groove for receiving therein latch members supported on the retrievable receptacle to secure the retrievable receptacle to the tubular member comprising the steps of:

releasably connecting the retrievable receptacle with tool means for lowering and positioning the retrievable receptacle landing shoulder on the well bore tubular member landing seat;

sealingly engaging the retrievable receptacle in the well bore tubular member;

maintaining the tool means connected with the retrievable receptacle to prevent relative longitudinal movement therebetween while lowering and positioning the retrievable receptacle on the well bore tubular member landing seat;

applying hydraulic pressure between the retrievable receptacle and tubular member to test the sealing engagement for leaks;

manipulating the tool means for longitudinal movement of the tool means relative to the retrievable receptacle to urge the latch members into the latching groove to secure the retrievable receptacle to the tubular member;

maintaining the tool means connected to the retrievable receptacle while moving the tool means longitudinally to secure the retrievable receptacle to the tubular member; and manipulating the tool means to disconnect and remove the tool means from the retrievable receptacle.

16. A method of securing a retrievable receptacle having a landing shoulder in a well bore tubular member provided with a landing seat and a latching groove for receiving therein latch members supported on the retrievable receptacle to secure the retrievable receptacle to the tubular member comprising the steps of:

releasably connecting the retrievable receptacle with tool means for lowering and positioning the retrievable receptacle landing shoulder on the well bore tubular member landing seat;

maintaining the tool means secured with the retrievable receptacle to prevent relative longitudinal movement therebetween while lowering and positioning the retrievable receptacle on the well bore tubular member landing seat;

sealingly engaging the retrievable receptacle in the well bore tubular member;

applying hydraulic pressure between the retrievable receptacle and tubular member to test the sealing engagement for leaks;

manipulating the tool means for longitudinal movement of the tool means relative to the retrievable receptacle to urge the latch members into the latching groove to secure the retrievable receptacle to the tubular member;

selectively applying a tension and/or compressive force on the tool means to test that the retrievable receptacle is secured to the tubular member;

maintaining the tool means connected with the retrievable receptacle while moving the tool means longitudinally to sealingly secure and test the retrievable receptacle in the tubular member; and rotating the tool means to disconnect and remove the tool means from the retrievable receptacle.

17. A retrievable landing assembly for supporting on a well string to actuate a setting sleeve and position a retrievable receptacle in a tubular member provided with a latching groove for receiving therein latch members supported on the retrievable receptacle including:

tool means;

first means for connecting said tool means with the retrievable receptacle;

second means operable by manipulation of the well string to disconnect said tool means from said first means for longitudinal movement relative to the retrievable receptacle to move the setting sleeve and urge the latch members into the latching groove; and additional means engaged with the retrievable receptacle to prevent withdrawal of said tool means from the retrievable receptacle while accommodating relative longitudinal movement therebetween.

18. The retrievable landing assembly of claim 17 wherein said first means includes a member threadedly engaged with said tool means.

19. The retrievable landing assembly of claim 18 wherein said second means includes cooperating surface means on said member and tool means to restrain relative movement therebetween whereby said tool means is disconnected from the retrievable receptacle by rotation of the well string.

20. The retrievable landing assembly of claim 19 wherein said additional means includes a coupling member threadedly engaged with the retrievable receptacle and cooperating surface means on said tool means and coupling member engagable whereby said coupling member is disengaged from the retrievable receptacle upon rotation of the well string for removal of said tool means from the retrievable receptacle.

21. The retrievable landing assembly of claim 17 including seal means on the retrievable receptacle for sealably engaging with the tubular member.

22. A retrievable landing assembly for supporting on a well string to actuate a setting sleeve and position a retrievable receptacle in a tubular member provided with a latching groove for receiving therein latch members supported on the retrievable receptacle including:

tool means having means for connecting it with the well string;

a member engaged with said tool means and having surface means which engage surface means on the retrievable receptacle whereby manipulation of said tool means by the well string releases said tool means from the retrievable receptacle for relative movement therebetween; and another member engaged with the retrievable receptacle to prevent withdrawal of said tool means from the retrievable receptacle while accommodating relative longitudinal movement therebetween.

23. The retrievable landing assembly of claim 22 including cooperating surface means on said tool means and said another member engagable whereby said another member is disengaged from the retrievable receptacle upon manipulation of the well string for removal of said tool means from the retrievable receptacle.

24. The retrievable landing assembly of claim 22 including seal means on the retrievable receptacle for sealably engaging with the tubular member.

25. A method of actuating a setting sleeve to position a retrievable receptacle with seal means and a landing shoulder in a tubular member provided with a landing seat and a latching groove for receiving therein latch members supported on the retrievable receptacle to secure the retrievable receptacle to the tubular member comprising the steps of:

releasably connecting the retrievable receptacle with tool means on a well string for lowering and positioning the retrievable receptacle landing shoulder on the tubular member landing seat;

manipulating the well string and tool means to disconnect the tool means from the retrievable receptacle for relative longitudinal movement therebetween whereby the tool means moves the setting sleeve to urge the latching members into the latching groove to sealably secure the retrievable receptacle with the tubular member; and maintaining the tool means coupled to the receptacle to prevent withdrawal of the tool means from the retrievable receptacle while positioning the retrievable receptacle in the tubular member.

26. The method of claim 25 including the step of selectively applying a tension and/or compressive force on the tool means to assure that the retrievable receptacle is secured to the tubular member.

27. The method of claim 25 including the step of manipulating the well string to uncouple the tool means from the retrievable receptacle.

28. A retrievable landing assembly for supporting on a well string to actuate a setting sleeve and position a retrievable receptacle in a tubular member provided with a latching groove for receiving therein latch members supported on the retrievable receptacle including:

tool means having means for connecting it with the well string;

a member threadedly engaged with said tool means and abutting the retrievable receptacle;

cooperating surface means on said member and the retrievable receptacle whereby rotation of the well string and tool means disengages said member from said tool means for longitudinal movement of said tool means relative to the retrievable receptacle to move the setting sleeve and urge the latch members into the latching groove; and another member threadedly engaged with the retrievable receptacle which is operative after said tool means is disengaged from said member for slidably receiving said tool means therethrough and which prevents withdrawal of said tool means from the retrievable receptacle while accommodating relative longitudinal movement of said tool means to actuate the setting sleeve.

29. The retrievable landing assembly of claim 28 including cooperating surface mans on said tool means and said another member engagable upon rotation of said tool means to unthread said another member from the retrievable receptacle whereby said tool means may be withdrawn from the retrievable receptacle.

30. The retrievable landing assembly of claim 29 wherein said cooperating surface means are longitudinally extending abutting surfaces on said tool means and said another member.

31. The retrievable landing assembly of claim 28 wherein said tool means said either said member or said another member include additional cooperating surface means which abut when a tension is applied to said tool means to determined that the retrievable receptacle is secured in position in the tubular member.

32. In a retrievable landing assembly for positioning a retrievable receptacle having a landing shoulder in a well bore tubular member provided with a landing seat and a latching groove for receiving latch members supported on the retrievable receptacle to secure the retrievable receptacle to the tubular member and wherein a setting sleeve for engaging and urging the latch members into the latching groove is releasably secured with the retrievable receptacle, the improvement comprising:

tool means movable to release the setting sleeve from the retrievable receptacle for longitudinal movement to urge the latch members into the latching groove;

releasable connecting means to releaseably connect said tool means with the retrievable receptacle against relative longitudinal movement therebetween;

said releasable connecting means including a member threadedly secured with said tool means, said connecting means member and the retrievable receptacle having cooperating engagable surface means to restrain relative rotation therebetween whereby said tool means may be rotated relative to said connecting means member for movement longitudinally when the retrievable receptacle landing shoulder is engaged on the tubular member landing seat to release the setting sleeve and urge the latch members into the latching groove; and additional means securing said tool means to the retrievable receptacle which is operative after said tool means is released from the retrievable receptacle to accommodate longitudinal movement of said tool means while preventing removal of said tool means from the retrievable receptacle, said additional means operable by rotation of said tool means to disconnect said tool means from the retrievable receptacle for removable of said tool means from the retrievable receptacle.

33. The invention of claim 32 wherein said connecting means member threadedly disengages from said tool means upon relative rotation therebetween whereby said tool means is released from said connecting means member and the retrievable receptacle for longitudinal movement relative thereto.

34. The retrievable landing assembly of claim 32 wherein said cooperating engagable surface means on said connecting means member and the retrievable receptacle which restrain relative rotation therebetween extend longitudinally of each said connecting means member and the retrievable receptacle.

35. In a retrievable landing assembly for positioning a retrievable receptacle having a landing shoulder in a well bore tubular member provided with a landing seat and a latching groove for receiving latch members supported on the retrievable receptacle to secure the retrievable receptacle to the tubular member and wherein a setting sleeve for engaging and urging the latch members into the latching groove is releasably secured with the retrievable receptacle, the improvement comprising:

tool means movable to engage and release the setting sleeve from the retrievable receptacle for longitudinal movement to urge the latch members into the latching groove;

releasable connecting means to releasably connect said tool means with the retrievable receptacle against relative longitudinal movement therebetween;

said releasable connecting means including a member threadedly secured with said tool means and abutting the retrievable receptacle, said member and the retrievable receptacle having longitudinally extending surfaces engagable to prevent relative rotation therebetween, said tool means rotatable for movement longitudinally of said member and the retrievable receptacle when the retrievable receptacle landing shoulder is engaged on the tubular member landing seat to release the setting sleeve and move it to urge the latch members into the latching groove; and additional means securing said tool means to the retrievable receptacle which is operative after said tool means is released from said member and the retrievable receptacle to accommodate the longitudinal movement of said tool means while preventing removal of said tool means from the retrievable receptacle, said additional means operable by rotation of said tool means to release said tool means from the retrievable receptacle.

36. The retrievable landing assembly of claim 28 including seal means on the retrievable receptacle for sealably engaging with the tubular member.

37. A setting tool for use in a well bore with a well tool requiring a longitudinal motion for operation including, a tubular member, adapted for coupling to a tubing string, first outer releasable interconnecting nut means for threadably interconnecting said tubular member to a well tool, said first releasable interconnecting nut means being slidably but non-rotatively mounted on said tubular member for permitting relative longitudinal motion between said tubular member and said first interconnecting nut means and for permitting corotation of said tubular member and said first nut means for releasing said first nut means from a well tool, second outer releasable interconnecting nut means for threadably interconnecting said tubular member to a well tool, said second releasable interconnecting nut means being arranged for non-rotative releasable interconnection to a well tool for permitting said tubular member to be releasable from interconnection with said second interconnecting nut means upon rotation of said tubular member relative to a well tool, said tubular member being arranged so that said tubular member has means providing a downwardly facing surface which is engagable with an upwardly facing surface on a well tool so that upon release of the threaded interconnection of said second interconnecting nut means relative to said tubular member, said tubular member can engage an upwardly facing surface on a well tool.

38. A setting tool for use in a well bore with a well tool requiring a longitudinal motion for operation including, telescopically mounted upper and lower tubular members, said upper tubular member being adapted for coupling to a tubing string, said lower tubular member being longitudinally movable from a first upper position to a second lower position with respect to said upper tubular member, a first outer releasable interconnecting nut means for threadably interconnecting said upper tubular member to a well tool, said first releasable interconnecting nut means being slidably but non-rotatively mounted on said upper tubular member for permitting relative longitudinal motion between said upper tubular member and said first interconnecting nut means and for permitting co-rotation of said upper tubular member and said first nut means for releasing said first nut means from a well tool, a second outer releasable interconnecting nut means for threadably interconnecting said upper tubular member to a well tool, said second releasable interconnecting nut means being arranged for non-rotative releasable interconnection to a well tool for permitting said upper tubular member to be releasable from interconnection with said second interconnecting nut means upon rotation of said upper tubular member relative to a well tool, said upper and lower tubular members being arranged so that said upper tubular member has a downwardly facing surface which is engagable with an upwardly facing surface on said lower member so that upon release from the threaded interconnection of said second interconnecting nut means, said upper tubular member can engage said lower member for longitudinally moving said lower tubular member conjunctively with said upper tubular member.

39. The apparatus as set forth in claim 38 wherein said lower tubular member and said upper tubular member are interconnected by a flange on one member which is slidably received in a recess in the other member.

40. The apparatus as set forth in claim 38 where said second nut means is located above said first nut means.

41. The apparatus as set forth in claim 38 wherein said second nut means is located above said first nut means and wherein lower tubular member and said upper tubular member are interconnected by a flange on one member which is slidably received in a recess in the outer member.

42. A setting tool and retrievable landing tool for use in a well bore system which has a downhole landing means and a landing tool locking means located in position in a well bore; including:

a retrievable landing tool having a telescopically mounted setting sleeve member and a setting collar member where said setting collar member has landing means for engaging downhole landing means in a well bore system, said setting sleeve member having tool locking means movable between a non-locking position and a locking position in response to longitudinal movement of said setting sleeve member relative to said setting collar member between a first upper position and a second lower position when said landing means engages downhole landing means, a retrievable setting tool having telescopically mounted upper tubular setting mandrel and lower tubular actuator sleeve member where said actuator sleeve member is movable between a first upper position and a second lower positon, means on said actuator sleeve member for mechanically engaging said setting sleeve member for conjunctively moving said actuator sleeve member and setting sleeve member longitudinally between said first positions and said second positions, first interconnecting nut means on said setting mandrel for threaded inter-connection of said setting mandrel to a well tool, said first interconnecting nut means being releasable from a well tool by rotation but permitting relative longitudinal movement of said setting mandrel with respect to said first interconnecting nut means, and second interconnecting nut means on said setting mandrel for threadable interconnection of said second interconnecting nut means to said setting mandrel, said second nut means having a releasable spline coupling with a well tool to prevent relative rotation of said second nut means so that said setting mandrel is releasable from said second interconnecting nut means by relative rotation of said setting sleeve member for permitting conjunctive longitudinal movement of said setting mandrel and said actuator sleeve member.

43. The apparatus as set forth in claim 42 wherein said setting sleeve member is movable between a second lower position and a third position and means for locking said setting sleeve member in said third upper position.

44. A setting tool for use in a well bore with a well tool requiring a longitudinal motion for operation including, telescopically mounted upper and lower tubular members, said upper tubular member being adapted for coupling to a tubing string, said lower tubular member being longitudinally movable from a first upper position to a second lower position with respect to said upper tubular member, a first releasable interconnecting nut means for threadably interconnecting said upper tubular member to a well tool, said first releasable interconnecting nut means being slidably but non-rotatively mounted on said upper tubular member for permitting relative longitudinal motion between said upper tubular member and said first interconnecting nut means and for permitting corotation of said upper tubular member and said first nut means for releasing said first nut means from a well tool, a second releasable interconnecting nut means for threadably interconnecting said upper tubular member to a well tool, said second releasable interconnecting nut means being arranged for non-rotative and releasable connection to a well tool for permitting said upper tubular member to be threadably relesable from connection with said second interconnecting nut means upon rotation of said upper tubular member relative to a well tool and releasable from connection with a well tool upon upward movement of said second nut means, said upper and lower tubular members being arranged so that said upper tubular member has a downwardly facing surface which is engagable with an upwardly facing surface on said lower member so that upon release from the threaded connection of said second connecting nut means, said upper tubular member can engage said lower member for longitudinally moving said lower tubular member conjunctively with said upper tubular member.

45. A setting tool and retrievable landing tool for use in a well bore system which has a downhole landing means and landing tool locking means located in position in a well bore, including:

a retrievable landing tool having telescopically mounted setting sleeve member and setting collar member where said setting collar member has landing means for engaging downhole landing means in a well bore system, said setting sleeve member having tool locking means movable between a non-locking position and a locking position in response to longitudinal movement of said setting sleeve member relative to said setting collar member between a first upper position and a second lower position when said landing means engages downhole landing means, a retrievable setting tool having a telescopically mounted upper tubular setting mandrel and a lower tubular actuator sleeve member where said actuator sleeve member is movable between a first upper position and a second lower position, means on said actuator sleeve member for mechanically engaging said setting sleeve member for conjunctively moving said actuator sleeve member and setting sleeve member longitudinally between said first positions and said second positions, first connecting nut means of said setting mandrel for threaded interconnection of said setting mandrel to a well tool, said first interconnecting nut means being releasable from a well tool by rotation but permitting relative longitudinal movement of said setting mandrel with respect to said first interconnecting nut means, and second connecting nut means on said setting mandrel for threaded interconnection of said second interconnecting nut means to said setting mandrel, said second nut means having a releasable coupling means cooperating with a well tool for preventing relative rotation of said second nut means so that said setting mandrel is releasable from said second interconnecting ut means by relative rotation of said setting sleeve member for permitting conjunctive longitudinal movement of said setting mandrel and said actuator sleeve member and so that said releasable coupling means is releasable from a well tool upon upward movement of said releasable coupling means relative to a well tool.

* * * * *